US010054015B2

(12) United States Patent
Becker

(10) Patent No.: US 10,054,015 B2
(45) Date of Patent: Aug. 21, 2018

(54) PARTICULATE TRAP FOR A CAMSHAFT PHASER

(71) Applicant: Schaeffler Technologies AG & Co. KG, Herzogenaurach (DE)

(72) Inventor: David Becker, White Lake, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 30 days.

(21) Appl. No.: 15/356,765

(22) Filed: Nov. 21, 2016

(65) Prior Publication Data

US 2018/0142584 A1 May 24, 2018

(51) Int. Cl.
*F01L 1/46* (2006.01)
*F01L 1/344* (2006.01)

(52) U.S. Cl.
CPC ..... *F01L 1/3442* (2013.01); *F01L 1/46* (2013.01); *F01L 2001/34436* (2013.01); *F01L 2001/34453* (2013.01); *F01L 2001/34479* (2013.01); *F01L 2001/34483* (2013.01)

(58) Field of Classification Search
CPC ... F01L 2001/34436; F01L 2001/34479; F01L 2001/34483; F01L 1/46
USPC ..... 123/90.17
See application file for complete search history.

(56) References Cited

U.S. PATENT DOCUMENTS

| | | | | |
|---|---|---|---|---|
| 3,841,489 | A | 10/1974 | Combest et al. | |
| 6,484,847 | B2 | 11/2002 | Paczuski | |
| 8,186,317 | B2 | 5/2012 | Najmolhoda et al. | |
| 2013/0186356 | A1* | 7/2013 | Schelter | F01L 1/46 123/90.15 |

* cited by examiner

*Primary Examiner* — Jorge Leon, Jr.

(57) ABSTRACT

A camshaft phaser, including: an axis of rotation; a stator with a radially outer surface including a plurality of teeth; a rotor located radially inwardly of the stator; a chamber bounded at least in part by the stator and the rotor; a locking cover; a spring cover non-rotatably connected to the locking cover; a space enclosed, at least in part, by the spring cover and the locking cover; a plurality of fasteners non-rotatably connecting the stator and the locking cover; a spiral spring located in the space and including a first end fixed to the stator; and a magnetic trap located within the space and including a magnet.

20 Claims, 8 Drawing Sheets

PARTICULATE TRAP FOR A CAMSHAFT PHASER

TECHNICAL FIELD

The present disclosure relates to a particulate trap for a camshaft phaser, in particular, a particulate trap including a magnet arranged to attract and capture magnetic particulate.

BACKGROUND

FIG. 8 is a partial cross-sectional view of prior art camshaft phaser 200 showing contaminated oil migration. FIG. 9 is a plan view of the check valve plate in FIG. 8. The following should be viewed in light of FIGS. 8 and 9. Camshaft phaser 200 includes: stator 202; rotor 204 located radially inward of stator 202; at least one chamber 206 bounded at least in part by stator 202 and rotor 204; locking cover 208; spring cover 210 non-rotatably connected to locking cover 208; space 212 enclosed, at least in part, by spring cover 210 and locking cover 208; channel 214 in cover 208; spiral spring 216 located in space 212, and check valve plate 218. Fluid 220, for example oil from an engine (not shown) including phaser 200, is present in space 212.

As is known in the art, fluid 220 flows into and out of chambers 206 to establish a rotational position of rotor 204 with respect to stator 202. For example, when fluid pressure in space 212 is greater than fluid pressure in chambers 206: fluid 220 displaces flaps 224 of plate 218 (covering channels 214) in axial direction AD1; and fluid 220 flows through channels 214 along path 222 into chambers 206. For example, when fluid pressure in space 212 is less than fluid pressure in chambers 206, fluid 220 in chambers 206 displaces flaps 224 in axial direction AD2 to block fluid flow out of chambers 206 and into space 212 through channels 214.

Fluid 220 typically becomes contaminated by magnetic and non-magnetic particulate generated by operation of the engine. In general, contamination degrades the phasing function of phaser 200. For example, the contaminant can interfere with operation of the check valve plate (for example preventing flaps 224 from properly opening or blocking channels 214). Interfering with operation of the check valve plate degrades operation of phaser 200, for example by preventing proper operation of the engine timing operations dependent upon the proper transport of fluid into and out of chambers 206.

SUMMARY

According to aspects illustrated herein, there is provided a camshaft phaser, including: an axis of rotation; a stator with a radially outer surface including a plurality of teeth; a rotor located radially inwardly of the stator; a chamber bounded at least in part by the stator and the rotor; a locking cover; a spring cover non-rotatably connected to the locking cover; a space enclosed, at least in part, by the spring cover and the locking cover; a plurality of fasteners non-rotatably connecting the stator and the locking cover; a spiral spring located in the space and including a first end fixed to the stator; and a magnetic trap located within the space and including a magnet.

According to aspects illustrated herein, there is provided a camshaft phaser, including: an axis of rotation; a stator with a radially outer surface including a plurality of teeth; a rotor; a locking cover; a spring cover including a radially outer side directly connected to the locking cover; a space enclosed by the locking cover and the spring cover; a spiral spring located in the space and including a first end fixed with respect to the stator; and a magnetic trap including a portion of the space and a magnet having a radially outwardly facing side, the magnet located within the portion of the space and radially between the spiral spring and the radially outer side of the spring cover. The portion of the space is enclosed, at least in part, by the locking cover, the spring cover and the magnet. The magnetic trap includes a plurality of magnetic field lines generated by the magnet, the plurality of magnetic field lines: passing radially inwardly through the portion of the space; and passing radially inwardly through the radially outwardly facing side of the magnet.

According to aspects illustrated herein, there is provided a method of operating a camshaft phaser including a stator, a rotor, a chamber bounded at least in part by the stator and the rotor, a spring cover having a radially outer wall directly connected to a locking cover, a space enclosed by the spring cover and the locking cover, a spiral spring located in the space, and a magnet located in the space, the method including: generating, with the magnet, magnetic field lines; and passing the magnetic field lines through the space.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
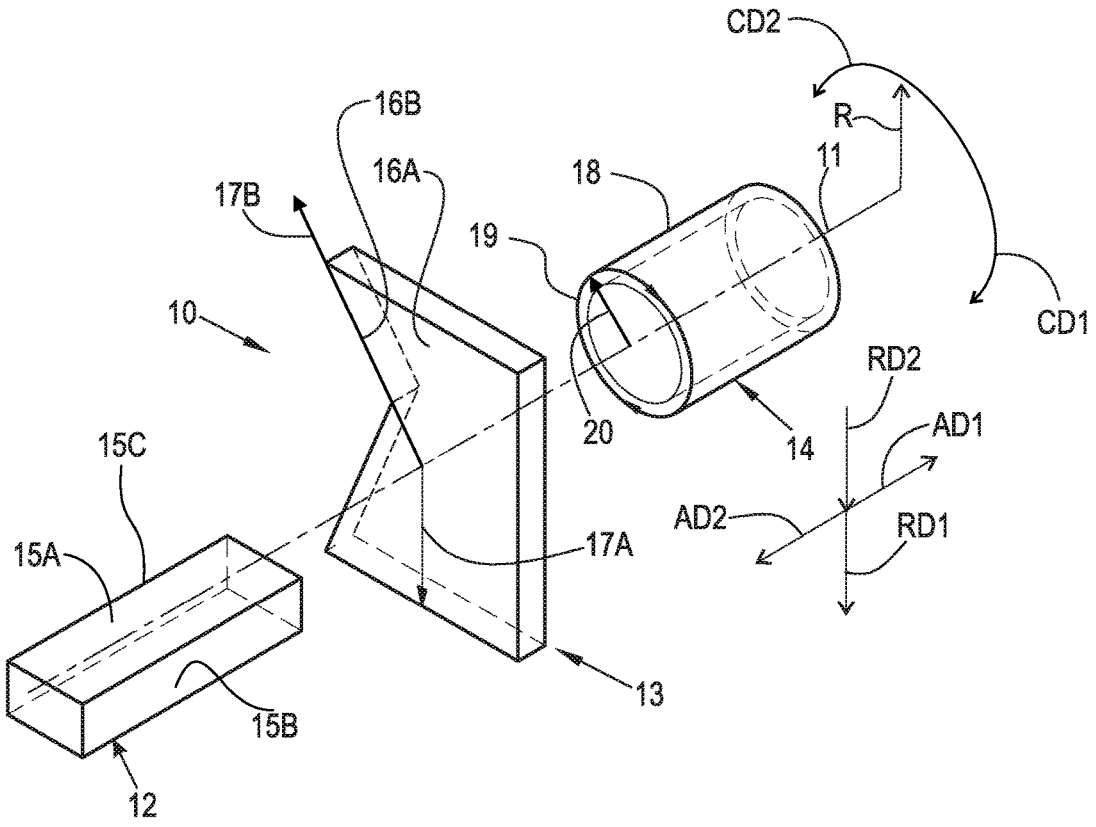
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes axis of rotation, or longitudinal axis, 11, used as the reference for the directional and spatial terms that follow. Opposite axial directions AD1 and AD2 are parallel to axis 11. Radial direction RD1 is orthogonal to axis 11 and away from axis 11. Radial direction RD2 is orthogonal to axis 11 and toward axis 11. Opposite circumferential directions CD1 and CD2 are defined by an endpoint of a particular radius R (orthogonal to axis 11) rotated about axis 11, for example clockwise and counterclockwise, respectively.

To clarify the spatial terminology, objects 12, 13, and 14 are used. As an example, an axial surface, such as surface 15A of object 12, is formed by a plane co-planar with axis 11. However, any planar surface parallel to axis 11 is an axial surface. For example, surface 15B, parallel to axis 11, but off-set from surface 15A in direction RD1, also is an axial surface. An axial edge is formed by an edge, such as edge 15C, parallel to axis 11. A radial surface, such as surface 16A of object 13, is formed by a plane orthogonal to axis 11 and co-linear with a radius, for example, radius 17A. A radial edge is co-linear with a radius of axis 11. For example, edge 16B is co-linear with radius 17B. Surface 18 of object 14 forms a circumferential, or cylindrical, surface. For example, surface 18 forms radially outer circumference 19 of object 14. Radially outer circumference 19 is defined by radius 20.

Axial movement is in direction axial direction AD1 or AD2. Radial movement is in radial direction RD1 or RD2. Circumferential, or rotational, movement is in circumferential direction CD1 or CD2. The adverbs "axially," "radially," and "circumferentially" refer to movement or orientation parallel to axis 11, orthogonal to axis 11, and about axis 11, respectively. For example, an axially disposed surface or edge extends in direction AD1, a radially disposed surface or edge extends in direction RD1, and a circumferentially disposed surface or edge extends in direction CD1.

Figure 2:
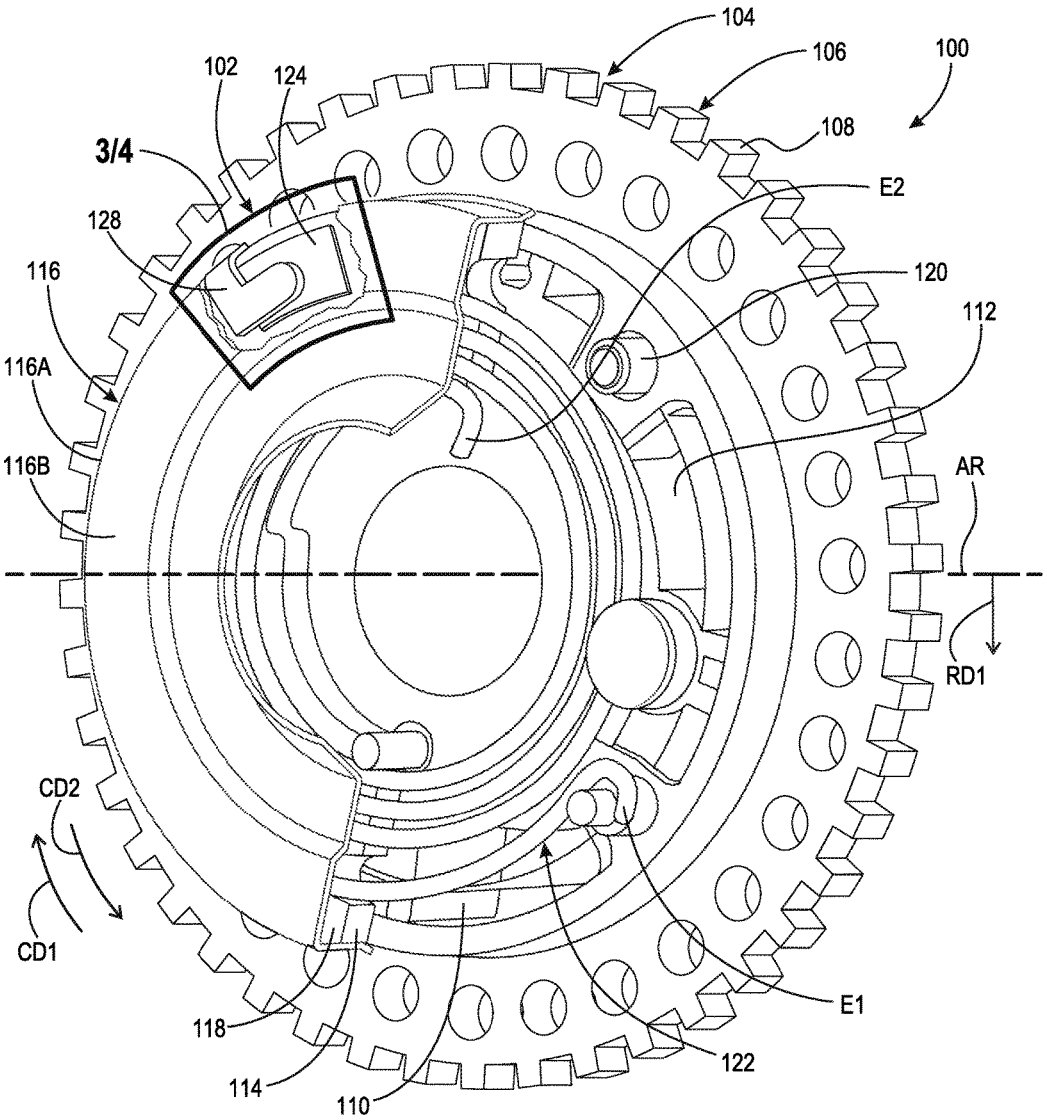
FIG. 2 is a cut-away view of a camshaft phaser with an example magnetic trap.

FIG. 2 is a cut-away view of camshaft phaser 100 with example magnetic trap 102.

Figure 3:
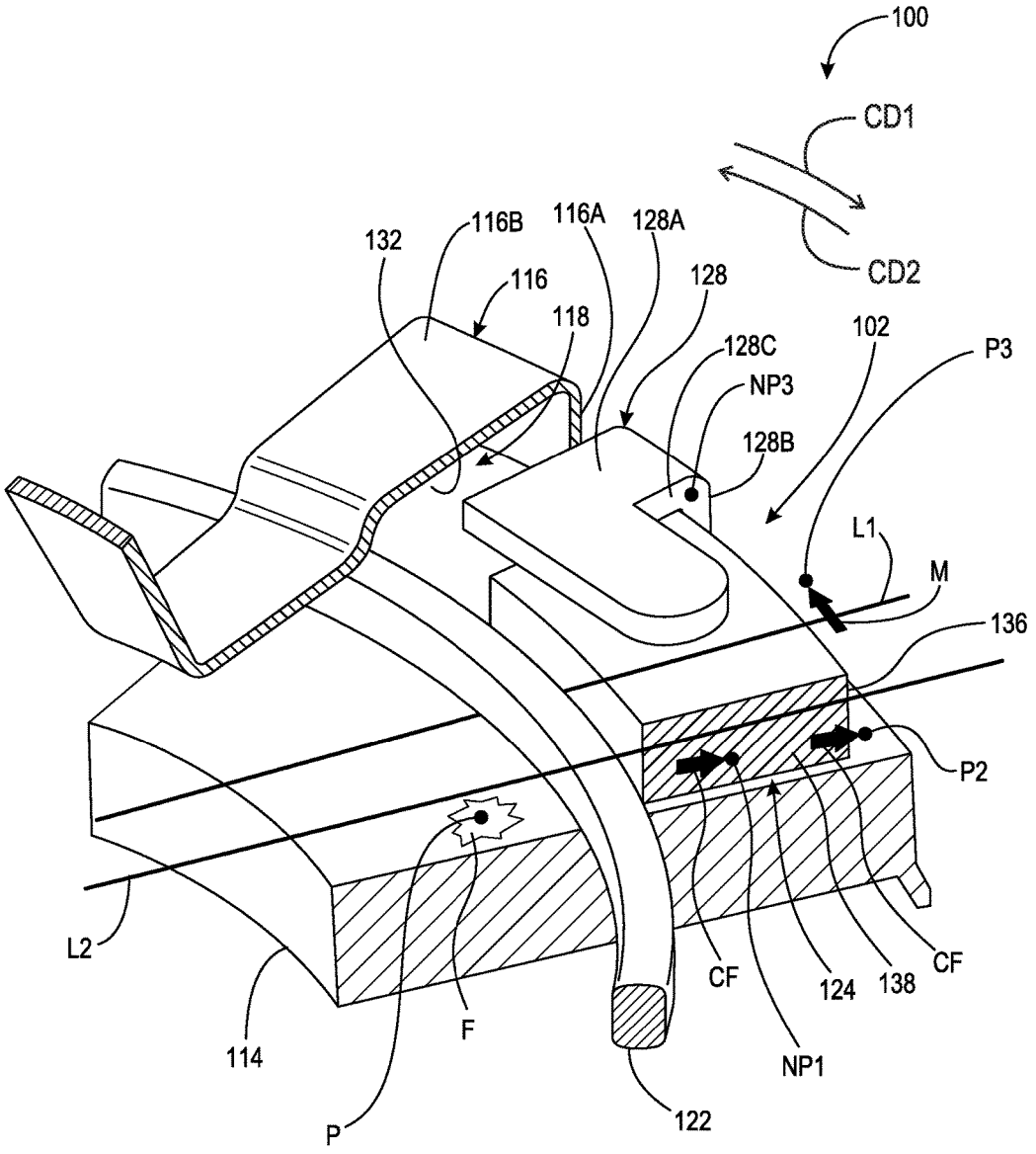
FIG. 3 is a perspective detail of area 3/4 in FIG. 2 with a spring cover plate further cut-away.

FIG. 3 is a perspective detail of area 3/4 in FIG. 2 with a spring cover plate further cut-away. The following should be viewed in light of FIGS. 2 and 3. Camshaft phaser 100 includes: axis of rotation AR; stator 104 with radially outer surface 106 including teeth 108; rotor 110 located radially inward of stator 104; chamber 112 bounded at least in part by stator 104 and rotor 110; locking cover 114; spring cover 116 non-rotatably connected to locking cover 114; space 118 enclosed, at least in part, by spring cover 116 and locking cover 114; fasteners 120 non-rotatably connecting stator 104 and locking cover 114; and spiral spring 122 located in space 118 and including end E1 fixed to stator 104 and end E2 fixed to rotor 110. Magnetic trap 102 is located in space 118 and includes magnet 124. Spring cover 116 includes radially outermost side 116A and axial side 116B. Spring 118 urges rotor 110 in circumferential direction CD2 with respect to stator 102.

Figure 4:
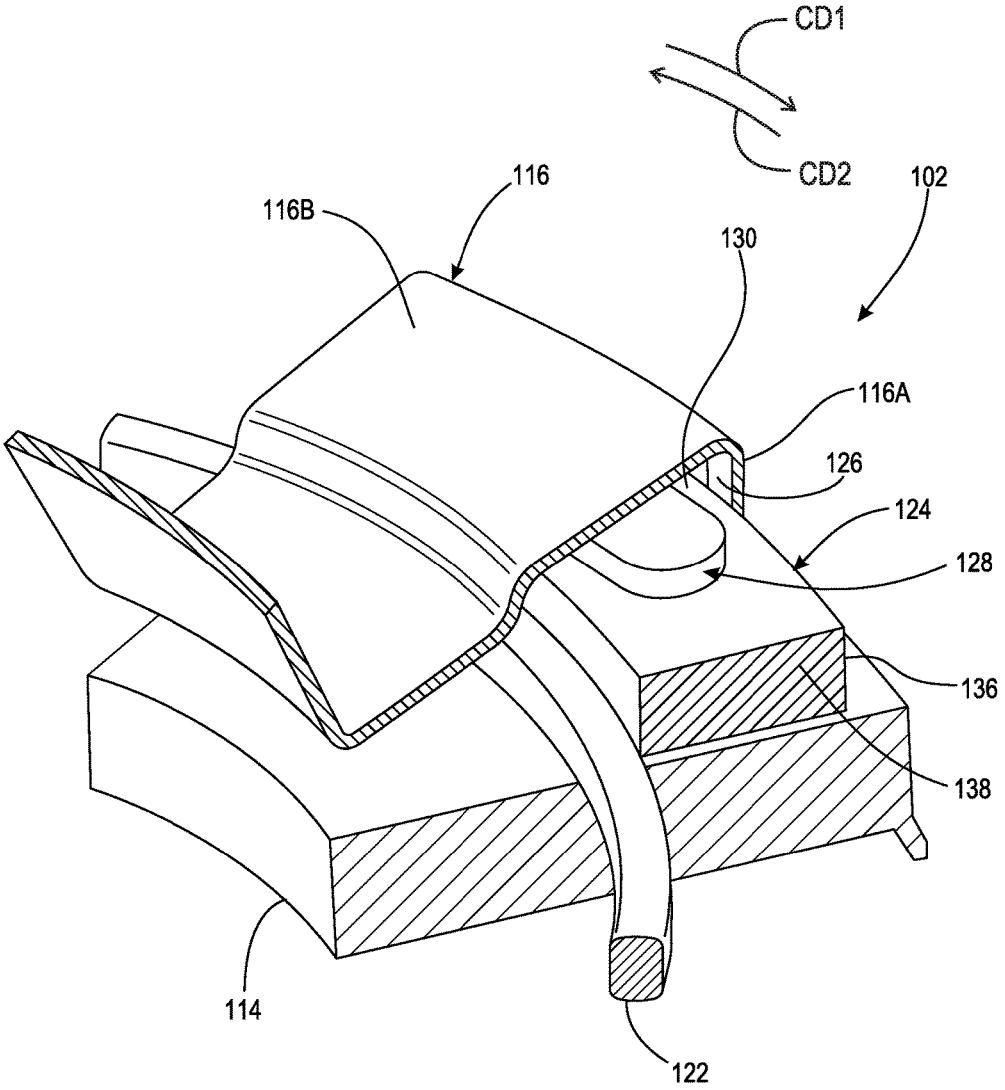
FIG. 4 is a perspective detail of area 3/4 in FIG. 2 with a portion of a spring cover plate overlapping a magnetic trap.

FIG. 4 is a perspective detail of area 3/4 in FIG. 2 with a portion of spring cover plate 116 overlapping magnetic trap 102. The following should be viewed in light of FIGS. 2 through 4. In an example embodiment, line L1, orthogonal to axis of rotation AR, passes through magnet 124 and spiral spring 122. Magnetic trap 102 includes portion 126 of space 118. Portion 126 is enclosed, at least in part, by locking cover 114, spring cover 116 and magnet 124. For example, locking cover 114 is sealed against spring cover side 116A and magnet 124 to enclose at least a part of portion 126.

In an example embodiment, magnetic trap 102 includes retaining pin 128 fixedly connecting magnet 124 to locking cover 114. In an example embodiment, portion 126 is bounded, in part, by retaining pin 128. In an example embodiment, portion 126 is wholly bounded by locking cover 114, spring cover 116, magnet 124 and retaining pin 128. For example: spring cover 116 is sealed against locking cover 114 and sides 128A and 128B of retaining pin 128; retaining pin 128 is sealed against magnet 124; and magnet 124 is sealed against locking cover 114. Portion 126 includes opening 130. In an example embodiment, opening 130 connects portion 126 to remainder 132 of space 118. By "remainder of space 118" we mean the part of space 118 not including portion 126. In an example embodiment, opening 130 is bounded by locking cover 114, spring cover 116, magnet 124 and retaining pin 128. In an example embodiment, opening 130 faces in circumferential direction CD1. In an example embodiment, portion 126 is blocked off from remainder 132 in circumferential direction CD2, for example by wall 128C of retaining pin 128.

Figure 5:
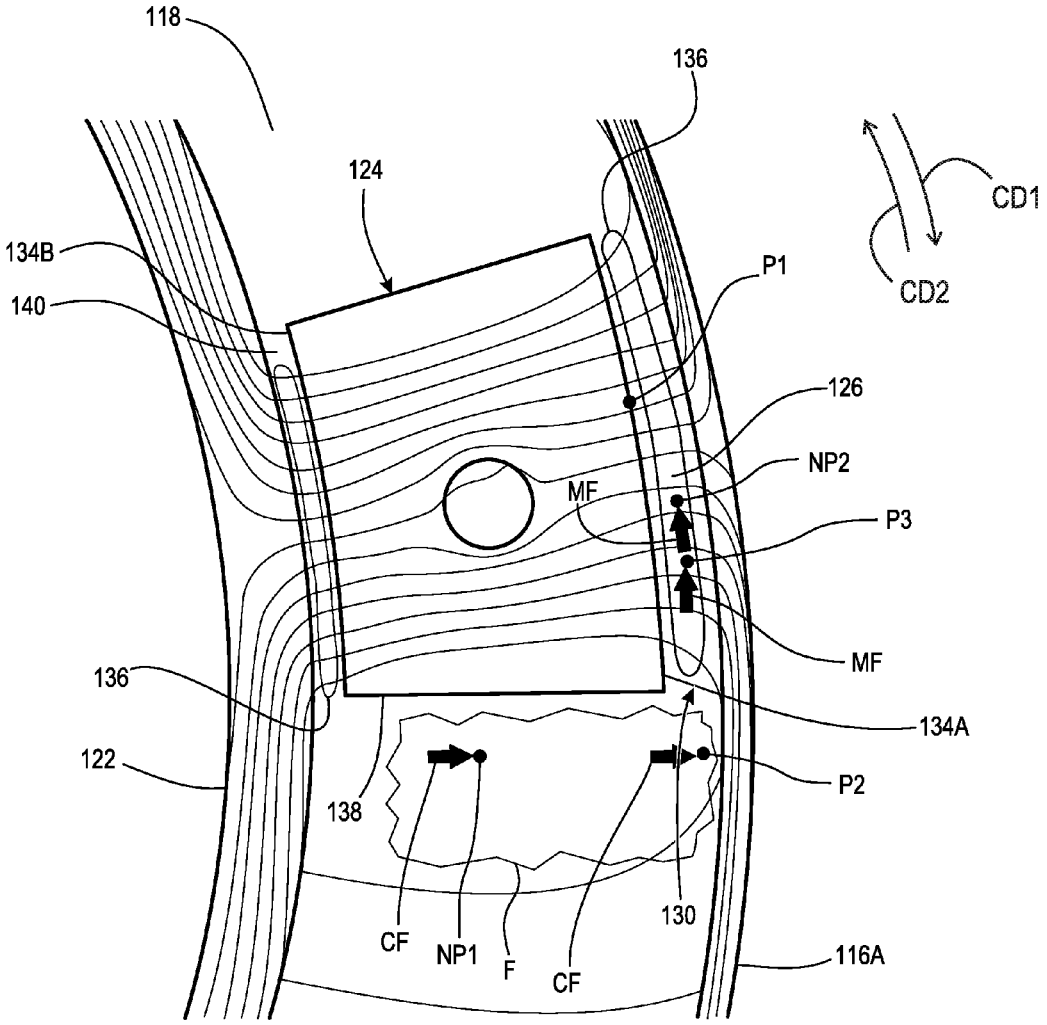
FIG. 5 is a plot of magnetic field lines generated by the magnetic trap in FIG. 2.

FIG. 5 is a plot of example magnetic field lines generated by magnetic trap 102 in FIG. 2. Magnet 124 includes side 134A facing, at least in part, radially outward. Magnetic trap 102 includes magnetic field lines 136, generated by magnet 124, passing radially inward through space 126 and side 134A. In the example of FIG. 5, lines 136 pass through side 134B of magnet 124, which faces, at least in part, radially inward.

In an example embodiment, portion 126 is bounded: on a radial inner side by side 134A of magnet 124; on a radial outer side by radially outermost wall 116A of spring cover 116; and axially by spring cover 116 and locking cover 114. In an example embodiment, line L2, orthogonal to axis of rotation AR, is co-linear with side 138.

Although magnetic trap 102 is shown configured with opening 130 facing in direction CD1, it should be understood that opening 130 can be configured with opening 130 facing in direction CD2, for example in instances in which phaser 100 rotates in direction CD2. In an example embodiment, magnet 124 is separated, in radial direction RD, orthogonal to axis of rotation AR, from spiral spring 122 by portion 140 of space 118.

The following should be viewed in light of FIGS. 2 through 5. The following describes a method of operating a camshaft phaser including a stator (for example stator 102), a rotor (for example rotor 110), a chamber bounded at least in part by the stator and the rotor (for example chamber 112), a spring cover (for example cover 116) having a radially outer wall (for example wall 116A) directly connected to a locking cover (for example cover 114), a space enclosed by the spring cover and the locking cover (for example space 118), a spiral spring located in the space (for example spring 122), and a magnet located in the space (for example magnet 124). Although the method is presented as a sequence of steps for clarity, no order should be inferred from the sequence unless explicitly stated. A first step, generates, with the magnet, magnetic field lines (for example field lines 136). A second step passes the magnetic field lines through the space. In an example embodiment, passing the magnetic field lines through the space includes passing the magnetic field lines radially inwardly through a portion of the space bounded, at least in part, by the magnet and the spring cover (for example portion 126).

In an example embodiment, a third step passes the magnetic field lines radially inwardly through a side of the magnet facing, at least in part, radially outwardly (for example side 134A). In an example embodiment, passing the magnetic field lines through the space includes passing the magnetic field lines radially inwardly through a portion of the space bounded on a radial inner side by a radially outwardly facing side of the magnet and bounded on a radial outer side by the spring cover (for example portion 126) and a fourth step passes the magnetic field lines radially inwardly through the radially outwardly facing side of the magnet.

In an example embodiment: a fifth step passes the plurality of magnetic field lines through fluid located in the space (for example fluid F); a sixth step adheres magnetic particulate P, suspended in fluid F, to the magnet; and a seventh step completes a magnetic circuit, including the plurality of magnetic field lines, with a return flux path through the spring cover. In the discussion that follows, Px, with 'x' being a digit, is used to designate an example magnetic particulate P.

In an example embodiment, passing the plurality of magnetic field lines through fluid located in the space includes passing the plurality of magnetic field lines through fluid located in a portion of the space (for example portion 126) bounded on a radial inner side by a radially outwardly facing side of the magnet (for example side 134A) and bounded on a radial outer side by the spring cover (for example by wall 116A), and adhering magnetic particulate, suspended in the fluid, to the magnet includes adhering the magnetic particulate to the radially outwardly facing side of the magnet (for example particulate P1).

Non-magnetic particulate NP also can be suspended in fluid F. In the discussion that follows, NPx, with 'x' being a digit, is used to designate an example magnetic particulate NP. In an example embodiment: an eighth step rotates the camshaft phaser in a first circumferential direction (for example circumferential direction CD1); a ninth step displace, radially outwardly, non-magnetic particulate NP1 suspended in fluid F and located outside of the portion of the space; a tenth step displaces, in a second circumferential direction opposite the first circumferential direction (for example, circumferential direction CD2), the non-magnetic particulate into the portion of the space (for example, non-magnetic particulate NP2 in space 126); and an eleventh step blocks displacement, in the second circumferential direction, of the non-magnetic particulate out of the portion of the space (for example, non-magnetic particulate NP3 in contact with pin wall 128C).

The following discussion assumes that phaser 100 rotates in circumferential direction CD1 during operation; however, it should be understood that for operation of phaser 100 in circumferential direction CD2, the circumferential configuration of magnetic trap 102 is reversed and circumferential directions CD1 and CD2 are reversed in the following discussion. Advantageously, magnetic trap 102 and a method utilizing magnetic trap 102 address the problem noted above with respect to contaminant in fluid F in phaser 100. For example, during operation of phaser 100 in circumferential direction CD1: centrifugal force CF displaces magnetic and non-magnetic particulate (for example, non-magnetic particulate NP1 and magnetic particulate P2) radially outwardly toward side 116A and in circumferential alignment with space 126; and momentum force MF of phaser 100, generated by the rotation of phaser 100, displaces both magnetic and non-magnetic particulate through opening 130 and into space 126 (for example, non-magnetic particulate NP2 and magnetic particulate P3). Momentum force MF hinders or prevents magnetic and non-magnetic particulate from exiting space 126 through opening 130 in circumferential direction CD1.

Once magnetic particulate is in space 126, magnet 124 attracts magnetic particulate and the magnetic particulate adheres to magnet 124, for example as shown by magnetic particulate P1. Hence, magnetic particulate is taken out of the fluid circuit of phaser 100 and cannot interfere with the operation of phaser 100. For non-magnetic particulate, wall 128C of pin 128 blocks movement of non-magnetic particulate, such as particulate NP3, out of space 126 in circumferential direction CD2 and momentum force MF prevents movement of non-magnetic particulate out of space 126 in circumferential direction CD1. Hence, non-magnetic particulate is taken out of the fluid circuit of phaser 100 and cannot interfere with the operation of phaser 100.

When phaser 100 ceases to rotate, gravitation force displaces fluid F downward, typically draining at least a portion of fluid F out of portion 126. As the fluid drains, magnetic particulate adhering to magnet 124 remains adhered to magnet 124 and typically at least a portion of the non-magnetic particulate in portion 126 remains in portion 126. Then, when phaser 100 rotates again, additional particulate in fluid F is displaced into portion 126 for capture in portion 126.

Figure 6:
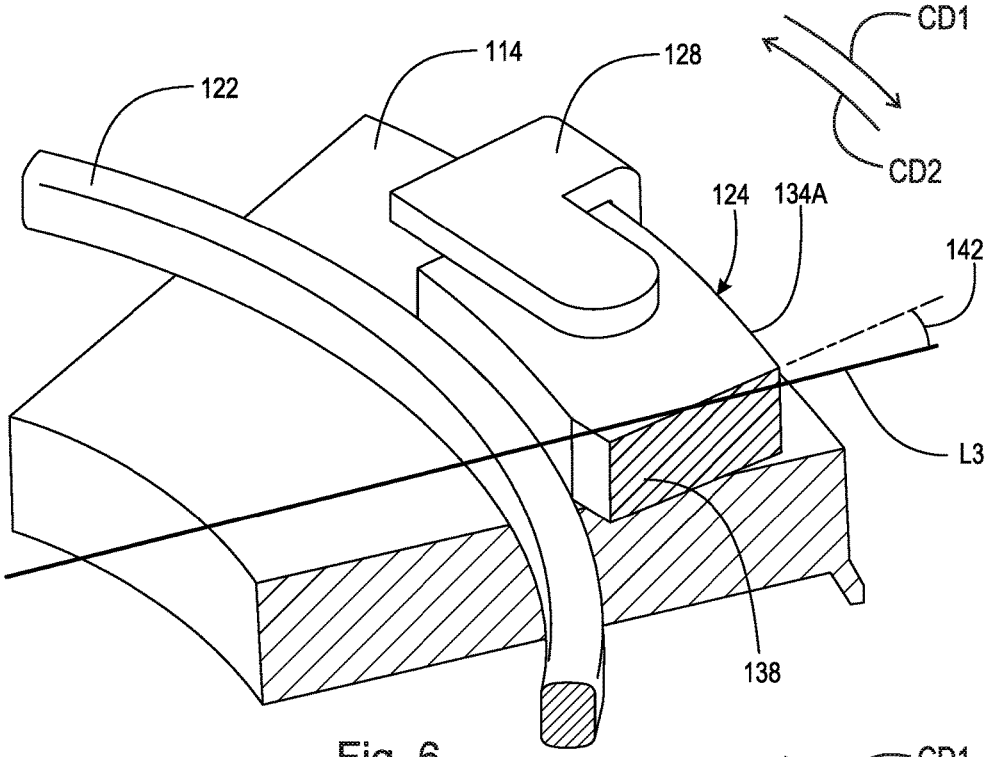
FIG. 6 is a perspective detail showing an example embodiment of a magnet for the magnetic trap.

FIG. 6 is a perspective detail of an example embodiment of magnet 124 in magnetic trap 102. In an example embodiment, line L3, orthogonal to axis of rotation AR, forms acute angle 142 with side 138 of magnet 124. The slope of side 138 in direction CD2 enhances the flow of magnetic and non-magnetic particulate into space 126 through opening 130. For example, it is easier for particulate to slide radially outwardly along side 138 in FIG. 6.

Figure 7:
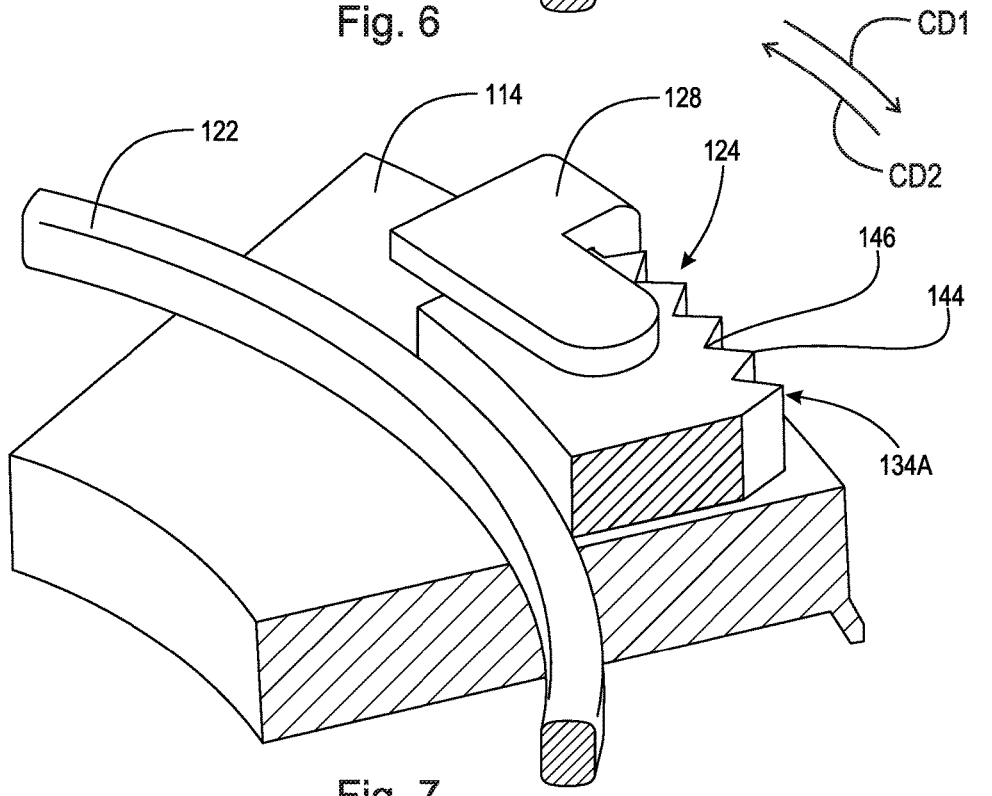
FIG. 7 is a perspective detail showing an example embodiment of a magnet for the magnetic trap.
Figure 8:
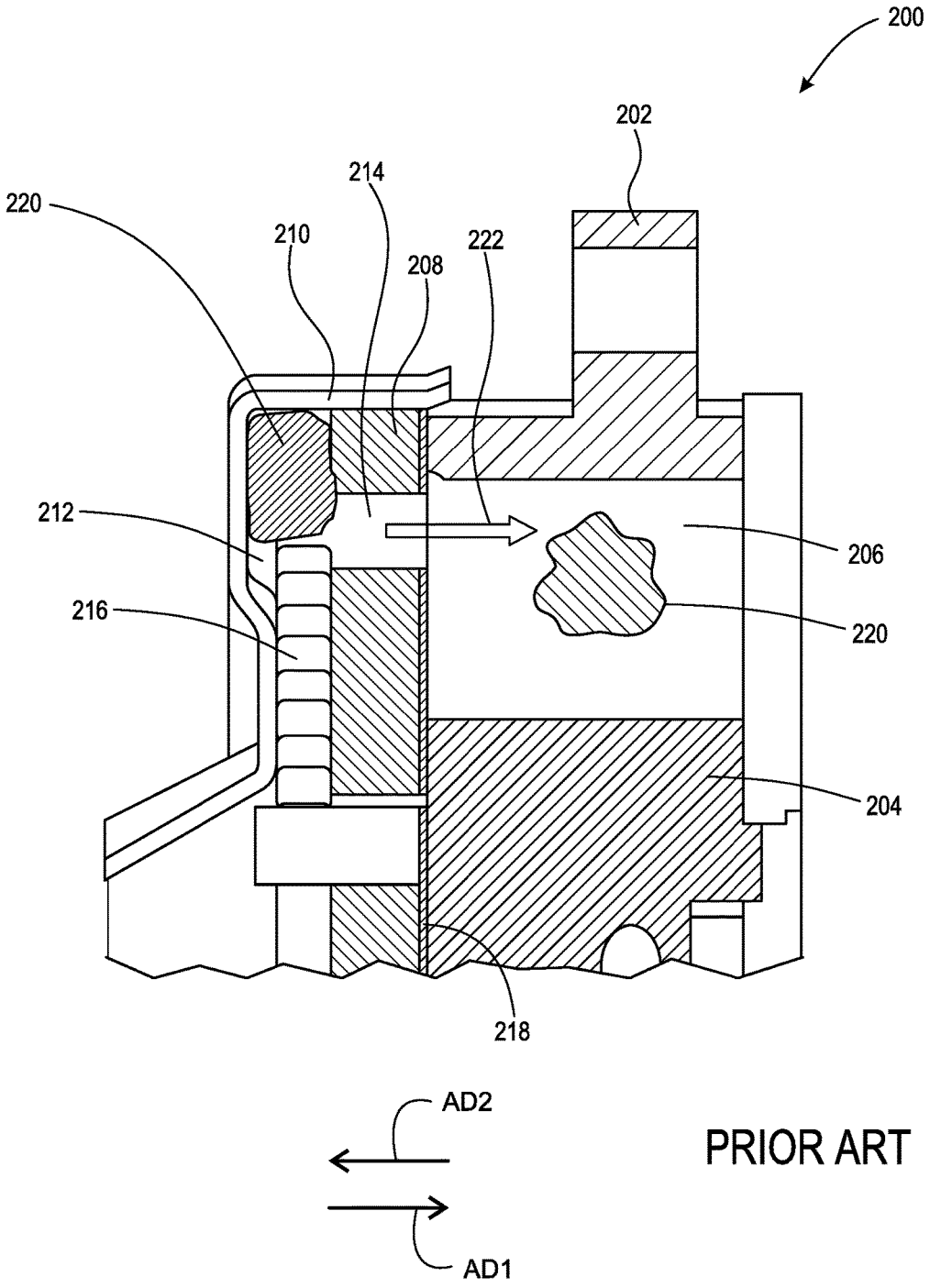
PRIOR ART Fig. 8
FIG. 8 is a partial cross-sectional view of a prior art camshaft phaser showing contaminated oil migration; and, FIG. 9 is a front view of the check valve plate in FIG. 8.
Figure 9:
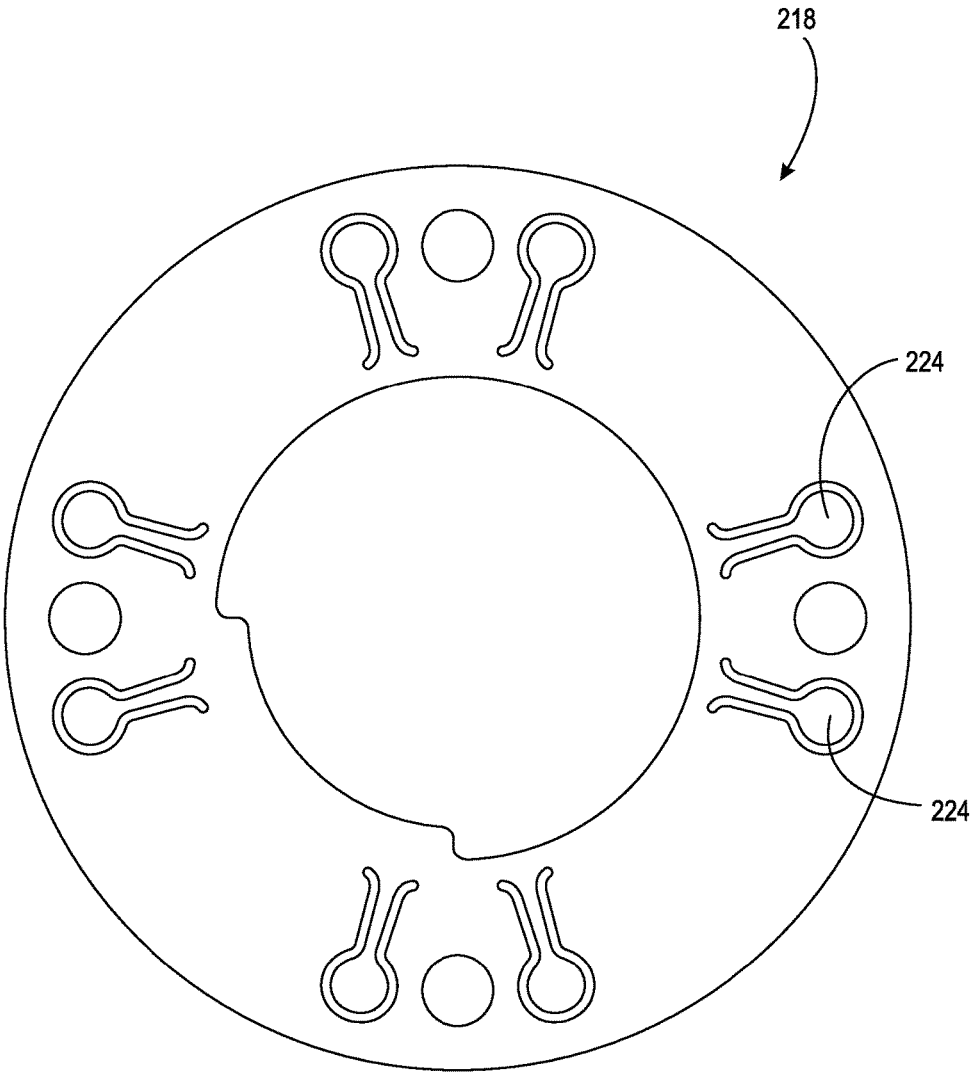
PRIOR ART Fig. 9

FIG. 7 is a perspective detail of an example embodiment of magnet 124 in magnetic trap 102. In an example embodiment, side 134A of magnet 124 includes saw teeth 144 and valleys 146. Teeth 144 and valleys 146 increase the surface area of side 134A, providing more area to which magnetic particulate adheres. In addition, valleys 146, between teeth 144, act as traps for non-magnetic particulate to aid retention of non-magnetic particulate in space 126.

It should be understood that magnet 124 is not limited to the shapes and configurations shown and that other shapes and configuration are possible. It should be understood that magnetic trap 102 is not limited to the orientation of field lines 136 shown in the figures. For example in an example embodiment (not shown), magnetic field lines pass radially inwardly through a circumferentially facing side of magnet 124, such side 138 or through a radially inwardly facing side of magnet 124, such as side 134B. Magnet 124 can be made of any material known in the art, including, but not limited to, molded powder metal, polymeric material, and elastomeric material.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A camshaft phaser, comprising:
an axis of rotation;
a stator with a radially outer surface including a plurality of teeth;
a rotor located radially inwardly of the stator;
a chamber bounded at least in part by the stator and the rotor;
a locking cover;
a spring cover non-rotatably connected to the locking cover;
a space enclosed, at least in part, by the spring cover and the locking cover;
a spiral spring located in the space and including a first end fixed to the stator; and,
a magnetic trap located within the space, the magnetic trap including a magnet.

2. The camshaft phaser of claim 1, wherein:
the magnet is separated, in a radial direction orthogonal to the axis of rotation, from the spiral spring; or,
a line orthogonal to the axis of rotation passes through the magnet and the spiral spring.

3. The camshaft phaser of claim 1, wherein the magnetic trap includes a portion of the space, the portion enclosed, at least in part, by the locking cover, the spring cover and the magnet.

4. The camshaft phaser of claim 3, wherein:
the magnetic trap includes a retaining pin fixedly connecting the magnet to the locking cover; and,
the portion of the space is bounded, in part, by the retaining pin.

5. The camshaft phaser of claim 4, wherein:
the portion of the space includes an opening:
facing in a first circumferential direction; and,
connecting the portion of the space to a remainder of the space; and,
the opening is bounded by the spring cover, the retaining pin, the magnet and the locking cover.

6. The camshaft phaser of claim 5, wherein:
the magnet includes a side facing, at least in part, radially outward; and,
the magnet trap includes at least one magnetic field line generated by the magnet, the at least one magnetic field line passing radially inwardly through the portion of the space and the side of the magnet.

7. The camshaft phaser of claim 5, wherein the portion of the space is sealed from the remainder of the space except for the opening.

8. The camshaft phaser of claim 1, wherein:
the magnet includes a first side facing, at least in part, radially outward; and,
the magnet trap includes a plurality of magnetic field lines generated by the magnet, the plurality of magnetic field lines passing radially inwardly through the first side.

9. The camshaft phaser of claim 8, wherein:
the magnetic trap includes a portion of the space bounded:
on a radial inner side by the first side of the magnet;
on a radial outer side by the spring cover; and,
axially by the spring cover and the locking plate; and,
the plurality of magnetic field lines passes through the portion of the space.

10. The camshaft phaser of claim 9, wherein:
the magnet includes a second side facing, at least in part, radially inwardly; and,
the plurality of magnetic field lines passes radially inwardly through the second side.

11. The camshaft phaser of claim 9, wherein the portion of the space is:
open to a remainder of the space in a first circumferential direction; and,
blocked off from the remainder of the space in a second circumferential direction, opposite the first circumferential direction.

12. The camshaft phaser of claim 1,
wherein the magnet includes a side facing in a circumferential direction; and,
wherein:
a line orthogonal to the axis of rotation is co-linear with the side; or,
the line orthogonal to the axis of rotation forms an acute angle with the side.

13. A camshaft phaser, comprising:
an axis of rotation;
a stator with a radially outer surface including a plurality of teeth;
a rotor;
a locking cover;
a spring cover including a radially outer side directly connected to the locking cover;
a space enclosed by the locking cover and the spring cover;
a spiral spring located in the space and including a first end fixed with respect to the stator; and,
a magnetic trap including:
a portion of the space; and,
a magnet having a radially outwardly facing side, the magnet located:
within the portion of the space; and,
radially between the spiral spring and the radially outer side of the spring cover, wherein:
the portion of the space is enclosed, at least in part, by the locking cover, the spring cover and the magnet; and,
the magnetic trap includes a plurality of magnetic field lines generated by the magnet, the plurality of magnetic field lines:
passing radially inwardly through the portion of the space; and,
passing radially inwardly through the radially outwardly facing side of the magnet.

14. A method of operating a camshaft phaser including a stator, a rotor, a chamber bounded at least in part by the stator and the rotor, a spring cover having a radially outer wall directly connected to a locking cover, a space enclosed by the spring cover and the locking cover, a spiral spring located in the space, and a magnet located in the space, the method comprising:
generating, with the magnet, magnetic field lines; and,
passing the magnetic field lines through the space.

15. The method of claim 14, wherein passing the magnetic field lines through the space includes passing the magnetic field lines radially inwardly through a portion of the space bounded, at least in part, by the magnet and the spring cover.

16. The method of claim 14, further comprising:
passing the magnetic field lines radially inwardly through a side of the magnet facing, at least in part, radially outwardly.

17. The method of claim 14, wherein passing the magnetic field lines through the space includes passing the magnetic field lines radially inwardly through a portion of the space bounded on a radial inner side by a radially outwardly facing side of the magnet and bounded on a radial outer side by the spring cover, the method further comprising:

passing the magnetic field lines radially inwardly through the radially outwardly facing side of the magnet.

18. The method of claim 14, further comprising:

passing the magnetic field lines through fluid located in the space; and, attracting magnetic particulate, suspended in the fluid, to the magnet.

19. The method of claim 18, wherein:

passing the magnetic field lines through fluid located in the space includes passing the magnetic field lines through fluid located in a portion of the space bounded on a radial inner side by a radially outwardly facing side of the magnet and bounded on a radial outer side by the spring cover, the method further comprising:

adhering the magnetic particulate to the radially outwardly facing side of the magnet.

20. The method of claim 18, further comprising:

rotating the camshaft phaser in a first circumferential direction;

displacing, radially outwardly, non-magnetic particulate suspended in the fluid and located outside of the portion of the space;

displacing, in a second circumferential direction opposite the first circumferential direction, the non-magnetic particulate into the portion of the space; and, blocking displacement, in the second circumferential direction, of the non-magnetic particulate out of the portion of the space.

* * * * *